US012663216B2

(12) United States Patent
Jeon

(10) Patent No.: US 12,663,216 B2
(45) Date of Patent: Jun. 23, 2026

(54) HEAT EXCHANGER

(71) Applicant: Hanon Systems, Daejeon (KR)

(72) Inventor: Young-Ha Jeon, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 88 days.

(21) Appl. No.: 18/721,944

(22) PCT Filed: Dec. 22, 2022

(86) PCT No.: PCT/KR2022/021066

§ 371 (c)(1),
(2) Date: Jun. 20, 2024

(87) PCT Pub. No.: WO2023/121344

PCT Pub. Date: Jun. 29, 2023

(65) Prior Publication Data

US 2025/0052504 A1 Feb. 13, 2025

(30) Foreign Application Priority Data

Dec. 22, 2021 (KR) ..... 10-2021-0184531
Dec. 21, 2022 (KR) ..... 10-2022-0180673

(51) Int. Cl.
*F28D 7/16* (2006.01)
*F28F 9/02* (2006.01)

(52) U.S. Cl.
CPC . *F28D 7/16* (2013.01); *F28F 9/02* (2013.01)

(58) Field of Classification Search
CPC ..... F28D 7/16; F28D 1/053; F28D 1/05366; F28D 1/05391; F25F 9/02; F25F 17/00; F25F 17/005

(Continued)

(56) References Cited

U.S. PATENT DOCUMENTS 7,784,529 B2 * 8/2010 Higashiyama ..... F28F 9/0278 165/174
8,146,652 B2 * 4/2012 Higashiyama ..... F28F 9/0204 165/174

(Continued)

FOREIGN PATENT DOCUMENTS

JP 2006207994 A 8/2006
JP 5002798 B2 8/2012

(Continued)

OTHER PUBLICATIONS

International Search Report issued in PCT/KR2022/021066 on Mar. 29, 2023.

*Primary Examiner* — Terrell L Mckinnon
(74) *Attorney, Agent, or Firm* — NORTON ROSE FULBRIGHT US LLP

(57) ABSTRACT

The present invention relates to a heat exchanger capable of ensuring sufficient cooling performance and drainage performance even in a narrow width, and the heat exchanger includes first and second header tanks into and from which a cooling fluid is introduced and discharged, the first and second header tanks being spaced apart from each other at a predetermined distance, and a core part disposed between the first and second header tanks, having a plurality of tubes and fins, and configured to perform a movement of the cooling fluid and heat exchange of the cooling fluid, in which a center of the outer header plate includes a first bent portion recessed toward the core part, and a drain hole is formed in the first bent portion, such that condensate water may be discharged.

17 Claims, 14 Drawing Sheets

(58) Field of Classification Search
USPC ..... 165/153, 176
See application file for complete search history.

(56) References Cited

U.S. PATENT DOCUMENTS

2007/0251681 A1* 11/2007 Higashiyama ..... F28D 1/05391 165/153
2008/0028788 A1* 2/2008 Higashiyama ..... F25B 39/02 62/515
2008/0041095 A1* 2/2008 Higashiyama ..... F25B 39/02 62/515
2008/0202153 A1* 8/2008 Watanabe ..... F28F 17/005 165/153
2008/0223566 A1* 9/2008 Higashiyama ..... F28D 1/05391 165/176
2009/0007592 A1* 1/2009 Higashiyama ..... F28D 1/05391 62/515
2009/0019885 A1* 1/2009 Hoshino ..... F28D 1/0417 165/181
2009/0236086 A1* 9/2009 Higashiyama ..... F28F 9/0204 165/176
2009/0282850 A1* 11/2009 Higashiyama ..... F28F 1/128 165/181
2014/0182330 A1* 7/2014 Kamoshida ..... F25B 39/022 62/524
2018/0283748 A1* 10/2018 Lee ..... F28F 9/028
2024/0044591 A1* 2/2024 Jeon ..... F28F 9/0246
2024/0210132 A1* 6/2024 Onaka ..... F28F 17/005
2025/0321064 A1* 10/2025 Jeon ..... F28F 9/028

FOREIGN PATENT DOCUMENTS

KR 20080075983 A 8/2008
KR 20100058026 A 6/2010
KR 20200080158 A 7/2020

* cited by examiner

HEAT EXCHANGER

CROSS-REFERENCE TO RELATED APPLICATIONS

This patent application is a national phase under 35 U.S.C. § 371 of International Patent Application No. PCT/KR2022/021066 filed Dec. 22, 2022, which claims the benefit of priority from Korean Patent Application Nos. 10-2021-0184531 filed Dec. 22, 2021, and 10-2022-0180673 filed Dec. 21, 2022, each of which is hereby incorporated herein by reference in its entirety for all purposes

TECHNICAL FIELD

The present invention relates to a heat exchanger, and more particularly, to a heat exchanger capable of ensuring sufficient cooling performance and drainage performance even in a narrow width and being conveniently assembled.

BACKGROUND ART

A heat exchange system includes a heat exchanger configured to absorb heat from the surroundings, a compressor configured to compress a refrigerant or heat medium, a condenser configured to dissipate heat to the surroundings, and an expansion valve configured to expand the refrigerant or heat medium. In a cooling system of the heat exchange system, a gaseous refrigerant, which is introduced into the compressor from the heat exchanger, is compressed to a high temperature and a high pressure in the compressor, liquefaction heat is dissipated to the surroundings during a process in which the compressed gaseous refrigerant is liquefied while passing through a condenser, the liquefied refrigerant is converted into low-temperature, low-pressure wet saturated vapor while passing through the expansion valve again, and then the refrigerant is introduced into the heat exchanger again and then vaporized, such that a cycle is implemented, and a substantial cooling operation is performed by the heat exchanger in which a liquid refrigerant is vaporized by absorbing the amount of heat, which corresponds to vaporization heat, from the surroundings.

Recently, in vehicle industries, the efficiency of components and parts, which includes fuel economy, has been continuously improved. In addition, external appearances of vehicles also tend to be diversified to meet the needs of various consumers. In response to this trend, research and development have been steadily conducted to lighten, miniaturize, and highly functionalize the components of the vehicles. In particular, even in the case of cooling devices for vehicles, there have been continuous efforts to develop a heat exchange system capable of ensuring a sufficient space in an engine room, having a small size to reduce a necessary volume, and having high efficiency.

DISCLOSURE

Technical Problem

An object of the present invention is to improve efficiency by changing a structure of a heat exchanger and reduce costs.

Another object of the present invention is to propose a structure of a heat exchanger capable of ensuring sufficient cooling performance and drainage performance even though the heat exchanger is manufactured to have a narrow width.

Still another object of the present invention is to provide a structure of a heat exchanger having a shape that is stable and conveniently assembled.

Technical problems to be solved by the present invention are not limited to the above-mentioned technical problems, and other technical problems, which are not mentioned above, may be clearly understood by those skilled in the art from the following descriptions.

Technical Solution

In order to achieve the above-mentioned objects, an embodiment of the present invention provides a heat exchanger including: first and second header tanks into and from which a cooling fluid is introduced and discharged, the first and second header tanks being spaced apart from each other at a predetermined distance; and a core part disposed between the first and second header tanks, having a plurality of tubes and fins, and configured to perform a movement of the cooling fluid and heat exchange of the cooling fluid, in which the first or second header tank includes: an outer header plate configured to define an outer periphery of the tank; and an inner header plate coupled to the plurality of tubes and the outer header plate and configured to define a closed cross-section, in which a center of the outer header plate includes a first bent portion recessed toward the core part, and in which a drain hole is formed in the first bent portion.

Advantageous Effects

According to the embodiment of the present invention, it is possible to reduce manufacturing costs for the heat exchanger in comparison with the related art.

In addition, it is possible to ensure sufficient heat exchange performance and drainage performance even in a narrow width.

In addition, it is possible to maintain a uniform distribution of the heat exchanger refrigerant and implement the effective condensate water discharge structure.

In addition, it is possible to stably and conveniently assemble the components such as the communication hole and the baffle.

The various, beneficial advantages and effects of the present invention are not limited to the above-mentioned contents and may be more easily understood during the process of describing the specific embodiments of the present invention.

BEST MODE

Figure 1:
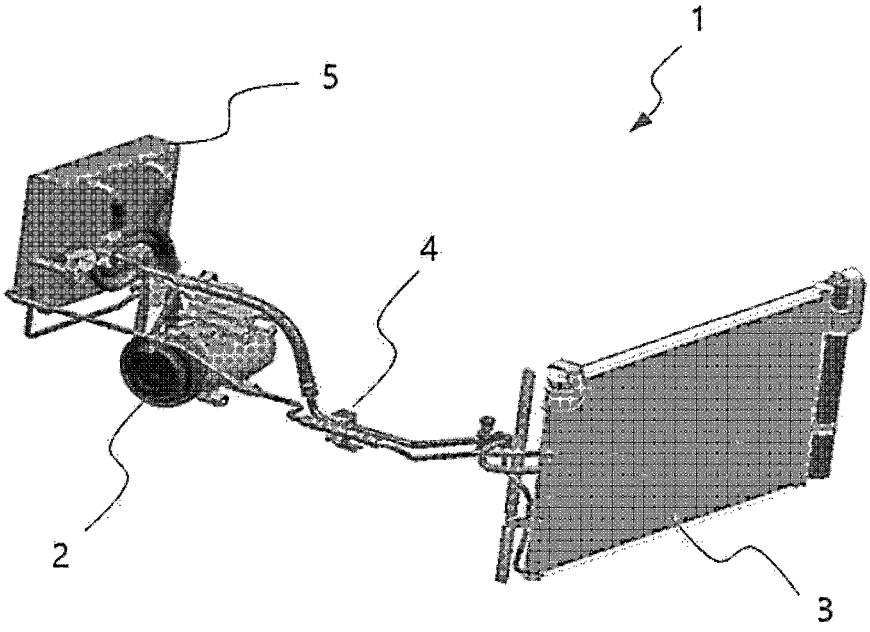
FIG. 1 is a view for explaining a structure of a general heat exchange system.

An embodiment of the present invention provides a heat exchanger including: first and second header tanks into and from which a thermally cooling fluid is introduced and discharged, the first and second header tanks being spaced apart from each other at a predetermined distance; and a core part disposed between the first and second header tanks, having a plurality of tubes and fins, and configured to perform a movement of the cooling fluid and heat exchange of the cooling fluid, in which the first or second header tank includes: an outer header plate configured to define an outer periphery of the tank; and an inner header plate coupled to the plurality of tubes and the outer header plate and configured to define a closed cross-section, in which a center of the outer header plate includes a first bent portion recessed toward the core part, and in which a drain hole is formed in the first bent portion.

In addition, a predetermined region of the outer header plate may be penetrated, and a main communication hole and an auxiliary communication hole may be formed to allow flow paths, which are divided into a plurality of tank zones, to communicate with one another.

In addition, a main communication hole plate may be coupled to a penetration region of the outer header plate having the main communication hole, and an auxiliary communication hole cover may be coupled to a penetration region of the outer header plate having the auxiliary communication hole.

In addition, the main communication hole may be formed to have a larger area than the auxiliary communication hole, and a height of a main communication cover plate may be higher than a height of an auxiliary communication cover plate.

In addition, an area of the auxiliary communication hole may be 6.5% or less of an area of the main communication hole.

In addition, a header plate fastening tab may protrude from a recessed portion of the inner header plate and be coupled to the outer header plate, a header plate fixing groove, into which the header plate fastening tab is inserted, may be formed in a recessed portion of the outer header plate, and condensate water may be discharged through the header plate fixing groove.

In addition, a main through-hole and an auxiliary through-hole, through which the cooling fluid flows, may be formed as a predetermined region of the outer header plate is penetrated, a main communication hole cover may be coupled to a penetration region of the outer header plate having the main communication hole, an auxiliary communication hole plate may be coupled to a penetration region of the outer header plate having the auxiliary communication hole, a main communication fastening tab may protrude from the recessed portion of the inner header plate to couple the main communication hole cover, and an auxiliary communication fastening tab may protrude from the recessed portion of the inner header plate to couple the auxiliary communication hole cover.

In addition, main communication fastening protruding portions may protrude from two opposite sides of the main communication hole cover and be coupled to the main communication fastening tab, or auxiliary communication fastening protruding portions may protrude from two opposite sides of the auxiliary communication hole cover and be coupled to the auxiliary communication fastening tab.

In addition, the outer header plate may include: a first outer partition wall recessed and bent toward the inside of the header tank; an outer coupling portion bent and extending from the first outer partition wall; and a second outer partition wall bent and extending from the outer coupling portion to the outside of the header tank, the inner header plate may include: a first inner partition wall recessed and bent toward the inside of the header tank; an inner coupling portion bent and extending from the first inner partition wall; and a second inner partition wall bent and extending from the inner coupling portion to the outside of the header tank, and the outer coupling portion of the outer header plate and the inner coupling portion of the inner header plate may be in contact with each other to define a closed cross-section.

In addition, a height of the first outer partition wall and the second outer partition wall of the outer header plate may be 60% or more of a height of the header tank.

In addition, the first header tank may further include a baffle configured to divide the flow path in the longitudinal direction or block one end in the longitudinal direction, and the baffle may include: baffle plates configured to block the flow path and formed at two opposite sides of a separation wall; a baffle connection portion configured to connect the baffle plates; baffle outer coupling portions formed at upper sides of the baffle plates and inserted into outer coupling grooves formed in the outer header plate; and baffle inner coupling portions formed at lower sides of the baffle plates and inserted into inner coupling grooves formed in the inner header plate.

In addition, a baffle coupling groove may be formed in the recessed portion of the inner header plate, and the baffle connection portion may be inserted into the baffle coupling groove.

In addition, the first header tank and the second header tank may be divided in accordance with a flow of the fluid, a region in which the fluid is introduced into the first header tank may be a first tank zone, an end region of a first pass through which the fluid descends from the first tank zone to the second header tank may be a second tank zone, one end region of a second pass connected to the second tank zone in the longitudinal direction and configured to allow the fluid to ascend to the first header tank may be a third tank zone, the other end region of the second pass may be a fourth tank zone, a region connected to the fourth tank zone through the main communication hole and the auxiliary communication hole may be a fifth tank zone, an end region of a third pass through which the fluid descends from the fifth tank zone to the second header tank may be a sixth tank zone, one end region of a fourth pass connected to the sixth tank zone in the longitudinal direction and configured to allow the fluid to ascend to the first header tank may be a seventh tank zone, a region, which is the other end region of the fourth pass through which the fluid is discharged to the outside of the heat exchanger, may be an eighth tank zone, a first throttle plate may be disposed in the third tank zone, and a second throttle plate may be disposed in the seventh tank zone.

In addition, the first or second throttle plate may include: a throttle opening through which the fluid passes; a throttle inner coupling portion coupled to the inner header plate; and a throttle outer coupling portion coupled to the outer header plate.

In addition, a cross-sectional area of the throttle opening may be 25 to 30% of a cross-sectional area of the header tank.

In addition, a cross-sectional area of the throttle opening may be 18 to 21% of a tube flow path cross-sectional area.

In addition, the first throttle plate may be disposed to be deflected from a center of the third tank zone to the second tank zone, or the second throttle plate may be disposed to be deflected from a center of the seventh tank zone to the sixth tank zone.

In addition, the first throttle plate may be disposed to be deflected from the center of the third tank zone to the second tank zone by 8 to 9% of a length of the third tank zone, or the second throttle plate may be disposed to be deflected from the center of the seventh tank zone to the sixth tank zone by 11 to 12% of a length of the seventh tank zone.

MODE FOR INVENTION

Hereinafter, exemplary embodiments of the present invention will be described in detail with reference to the accompanying drawings. However, the technical spirit of the present invention is not limited to some embodiments described herein but may be implemented in various different forms. One or more of the constituent elements in the embodiments may be selectively combined and substituted within the scope of the technical spirit of the present invention. The same or corresponding constituent elements are assigned with the same reference numerals regardless of reference numerals, and the repetitive description thereof will be omitted.

In addition, unless otherwise specifically and explicitly defined and stated, the terms (including technical and scientific terms) used in the embodiments of the present invention may be construed as the meaning which may be commonly understood by the person with ordinary skill in the art to which the present invention pertains. The meanings of the commonly used terms such as the terms defined in dictionaries may be interpreted in consideration of the contextual meanings of the related technology.

In the present specification, unless particularly stated otherwise, a singular form may also include a plural form. The expression "at least one (or one or more) of A, B, and C" may include one or more of all combinations that can be made by combining A, B, and C. In addition, the terms first, second, A, B, (a), and (b) may be used to describe constituent elements of the embodiments of the present invention. These terms are used only for the purpose of discriminating one constituent element from another constituent element, and the nature, the sequences, or the orders of the constituent elements are not limited by the terms.

Further, when one constituent element is described as being 'connected,' 'coupled,' or 'attached' to another constituent element, one constituent element can be connected, coupled, or attached directly to another constituent element or connected, coupled, or attached to another constituent element through still another constituent element interposed therebetween. In addition, the explanation "one constituent element is formed or disposed above (on) or below (under) another constituent element" includes not only a case in which the two constituent elements are in direct contact with each other, but also a case in which one or more additional constituent elements are formed or disposed between the two constituent elements. In addition, the expression "above (on) or below (under)" may include a meaning of a downward direction as well as an upward direction based on one constituent element.

First, FIG. 1 illustrates a structure of a general heat exchange system 1. With reference to FIG. 1, the heat exchange system 1 includes a compressor 2 configured to compress a refrigerant or heat medium, a condenser 3 configured to dissipate heat to the surroundings, an expansion valve 4 configured to expand the refrigerant or heat medium, and an evaporator 5 configured to receive a liquid refrigerant, which is depressurized to a low temperature and a low pressure while passing through the expansion valve, and allow the liquid refrigerant to exchange heat with a cooling target object to absorb heat by means of liquid evaporation.

In this case, a thickness of the evaporator 5 directly affects cooling performance and a size of the heat exchange system 1. In case that a thickness of the evaporator 5 is large, sufficient cooling performance is easily achieved, but there is a problem in that a thickness of the heat exchange system 1 is also increased. On the contrary, in case that the evaporator is designed to be thin, the size of the heat exchange system 1 may decrease. However, it is difficult to achieve sufficient cooling performance, and there is a limitation in applying a structure for discharging condensate water produced in the evaporator 5, which adversely affects cooling performance, odor, corrosion, and the like. In particular, in case that the thickness of the evaporator is designed to be 40 mm or less to meet a recent demand for a reduction in volume of the heat exchange system for compact designs, it is difficult to implement a smooth condensate water discharge structure while achieving sufficient cooling performance. Therefore, the present invention proposes a structure capable of ensuring sufficient cooling performance and drainage performance even though the evaporator is manufactured to have a narrow width. Because the proposal of the present invention may be applied to a structure of a heat exchanger 1000 in addition to the evaporator 5, the embodiment of the present invention will be described in detail by using the term 'heat exchanger 1000 that is a high-level concept of the evaporator.

Figure 2:
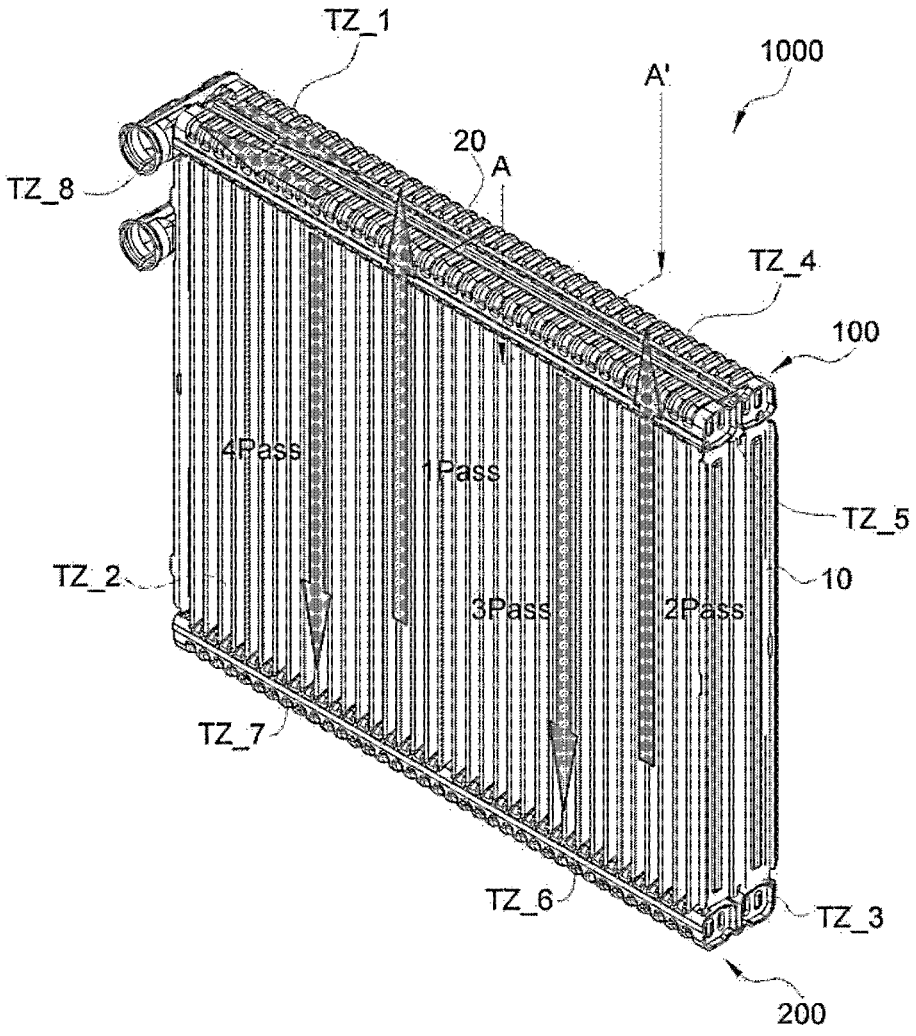
FIG. 2 is a perspective view for explaining a flow path structure of a heat exchanger according to an embodiment of the present invention.

First, FIG. 2 illustrates a flow path structure of the heat exchanger 1000 according to the embodiment of the present invention. With reference to FIG. 2, a fluid is introduced into a first tank zone TZ_1 of a first header tank 100, which is positioned at an upper side, from the outside, the fluid descends from the first tank zone TZ_1 to a second tank zone TZ_2 of a second header tank 200 through a first pass, and the fluid passes through a third tank zone TZ_3, which is connected to the second tank zone TZ_2 in a longitudinal direction, and ascends to the first header tank 100 through a second pass. The fluid, which has ascended, is introduced into a fourth tank zone TZ_4 of the first header tank 100 and introduced into a fifth tank zone TZ_5 through a communication hole, and then the fluid descends to a sixth tank zone TZ_6 of the second header tank 200 through a third pass. Thereafter, the fluid flows so that the fluid passes through a seventh tank zone TZ_7, which is connected to the sixth tank zone TZ_6 in the longitudinal direction, and is introduced into an eighth tank zone TZ_8 of the first header tank 100 through a fourth pass, and then the fluid is discharged to the outside from the eighth tank zone TZ_8.

In this case, in the first header tank 100, a flow path is divided in the width direction by a bent portion of an outer header plate 110 and/or a bent portion of an inner header plate 120, and the flow path is divided in the longitudinal direction by a baffle 300, such that the plurality of tank zones is distinguished.

Figure 3:
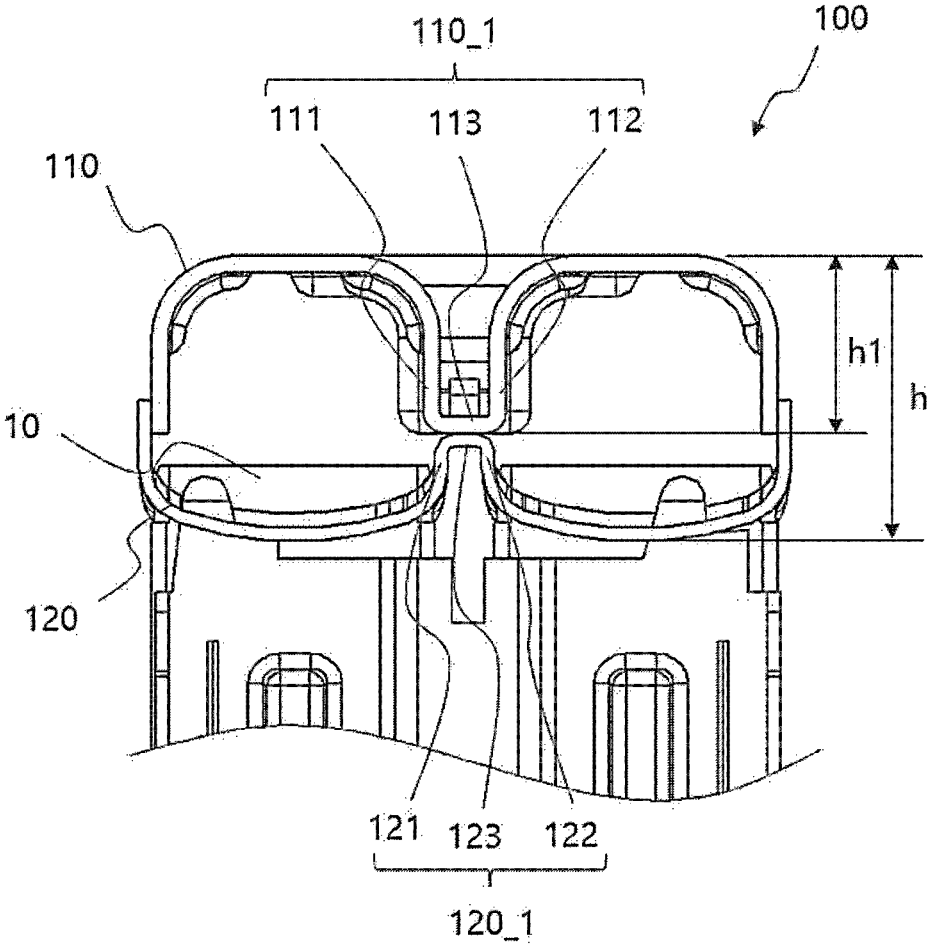
FIG. 3 is a cross-sectional view taken along line A-A' in FIG. 2.

FIG. 3 is a cross-sectional view taken along line A-A' in FIG. 2. With reference to FIG. 3, the first header tank 100 of the present invention includes the outer header plate 110 configured to define an outer periphery of the header tank, and the inner header plate 120 coupled to a plurality of tubes 10 and the outer header plate 110 and configured to define a closed cross-section. In this case, a center of the outer header plate 110 and a center of the inner header plate 120 are recessed and bent toward the inside of the tank, and the bent portions are joined to each other to divide the flow path. Therefore, the flow path of the first header tank 100 is divided into a plurality of spaces in the width direction. The structure of the header tank of the present invention will be described in more detail. In the outer header plate 110 according to the embodiment of the present invention, a first outer partition wall 111 recessed and bent toward the inside of the header tank, an outer coupling portion 113 bent and extending from the first outer partition wall 111, and a second outer partition wall 112 bent and extending from the outer coupling portion 113 to the outside of the header tank define a first bent portion 110_1. In the inner header plate 120, a first inner partition wall 121 recessed and bent toward the inside of the header tank, an inner coupling portion 123 bent and extending from the first inner partition wall 121, and a second inner partition wall 122 bent and extending from the inner coupling portion 123 to the outside of the header tank define a second bent portion 120_1. The outer coupling portion 113 of the outer header plate 110 and the inner coupling portion 123 of the inner header plate 120 may be in contact with each other to define a closed cross-section.

In this case, a height h2 of the first outer partition wall 111 and the second outer partition wall 112 of the outer header plate 110 may be higher than a height h of the header tank, and the height h2 of the first outer partition wall 111 and the second outer partition wall 112 may be 60% or more of the height h of the header tank.

If the inner header plate 120 is formed to be flat without being bent, the first bent portion 110_1 of the outer header plate 110 may be in contact with the flat portion of the inner header plate 120 to define a closed cross-section without the second bent portion 120_1.

Figure 4:
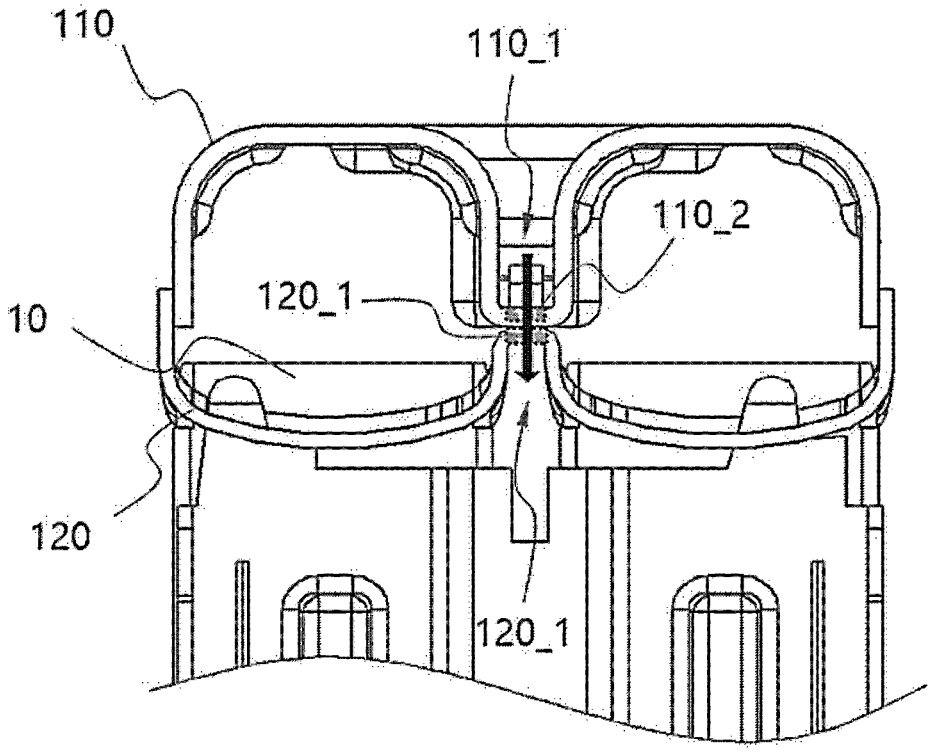
FIG. 4 is a view for explaining a condensate water discharge hole according to the embodiment of the present invention.

FIG. 4 is a view for explaining a condensate water discharge hole according to the embodiment of the present invention. With reference to FIG. 4, a first through-hole 110_2 may be formed in the first bent portion 110_1, a second through-hole 120_2 may be formed in the second bent portion 120_1, and the first through-hole 110_2 and the second through-hole 120_2 communicate with each other to define a drain hole through which condensate water is discharged. The arrow in FIG. 4 schematically illustrates that condensate water is discharged through the first through-hole 110_2 and the second through-hole 120_2.

Figure 5:
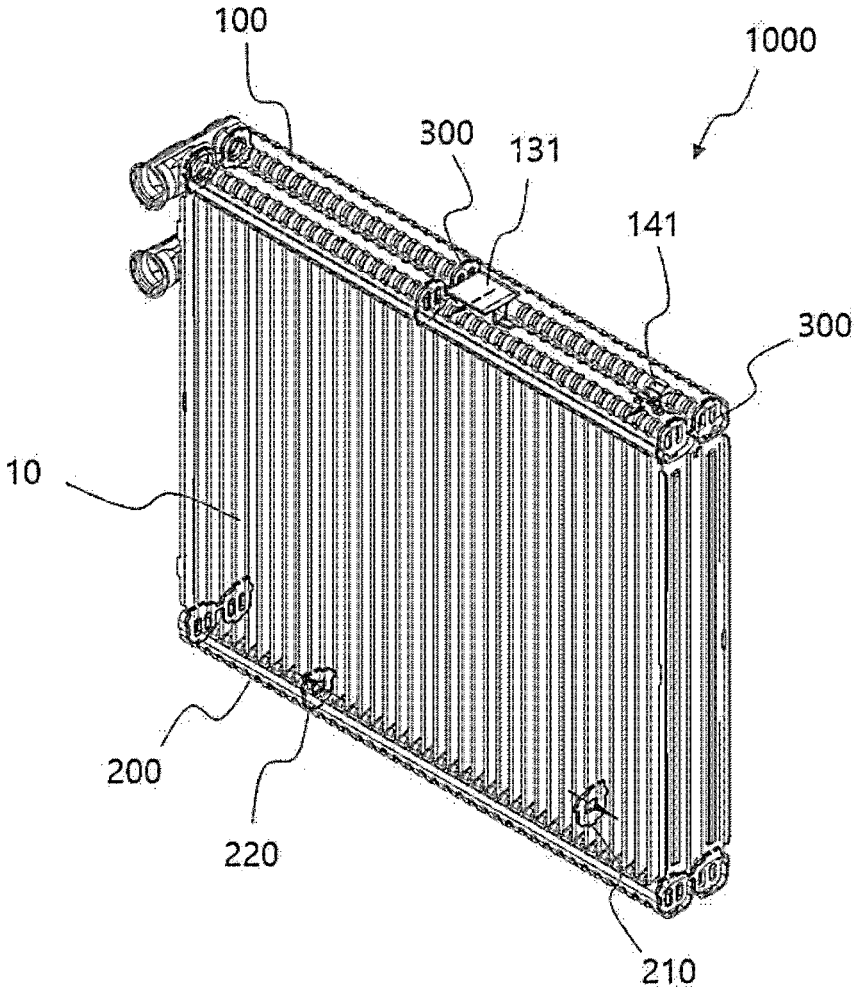
FIG. 5 is a view illustrating a communication hole and a throttle according to the embodiment of the present invention.

FIG. 5 is a view illustrating a communication hole and a throttle according to the embodiment of the present invention. With reference to FIG. 5, a main communication hole 130 and an auxiliary communication hole 140 are formed in the separation wall of the first header tank 100, and the fluid moves from the fourth tank zone TZ_4 to the fifth tank zone TZ_5 through the main communication hole 130 and the auxiliary communication hole 140.

In addition, the second header tank 200 includes a plurality of throttle plates 210 and 220 configured to adjust a flow rate in the longitudinal direction. In this case, a first throttle plate 210 may be disposed in the above-mentioned third tank zone TZ_3, and a second throttle plate 220 may be disposed in the seventh tank zone TZ_7. As described above, the two throttle plates are disposed in the tank zones of the second header tank 200, such that the refrigerant is distributed equally to the tubes, which improves the cooling performance and the temperature distribution.

Figure 6:
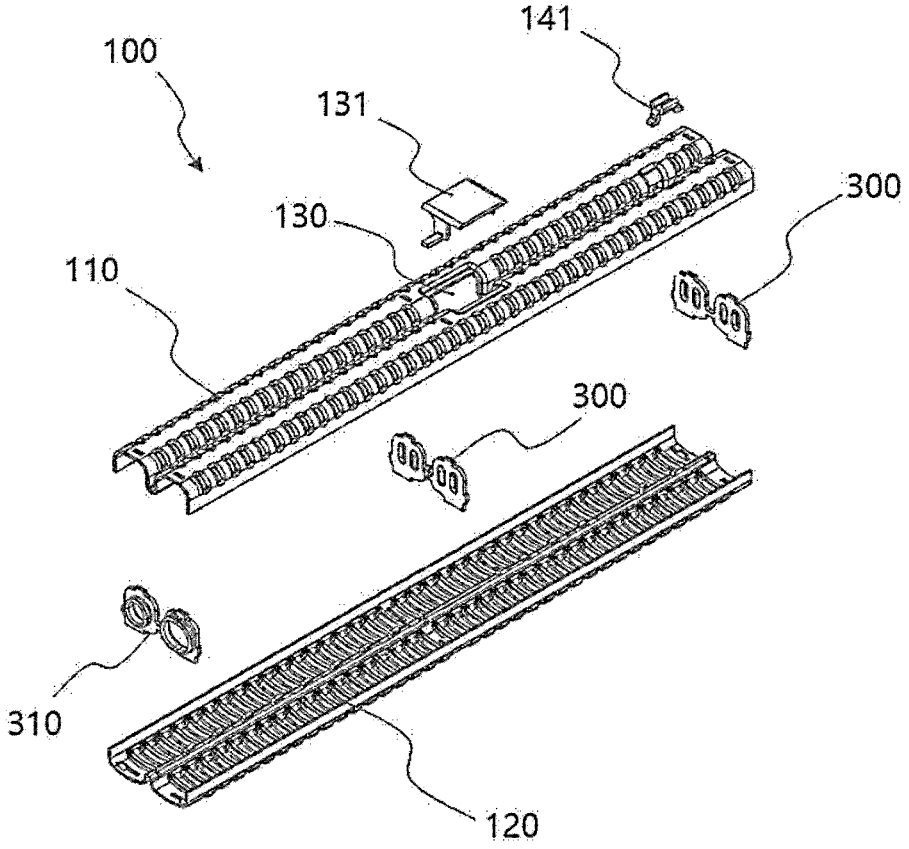
FIG. 6 is an exploded perspective view of a header tank according to the embodiment of the present invention.
Figure 7:
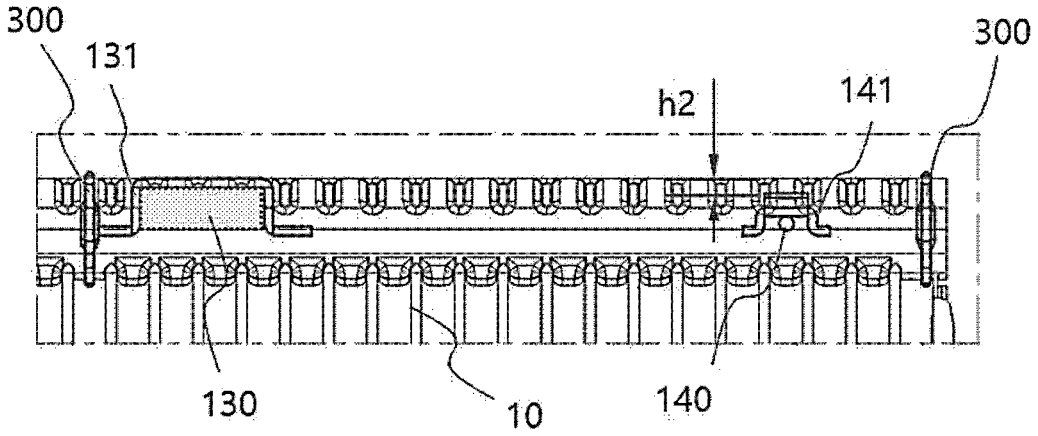
FIG. 7 is a view for explaining a main communication hole and an auxiliary communication hole according to the embodiment of the present invention.
Figure 8:
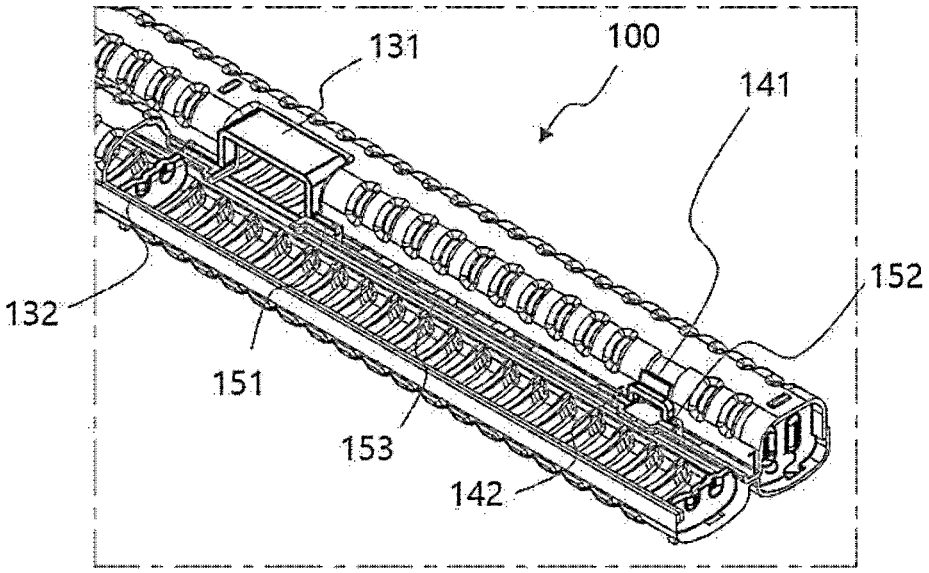
FIG. 8 is a view for explaining a structure for fastening a main communication hole cover and an auxiliary communication hole cover according to the embodiment of the present invention.
Figure 9:
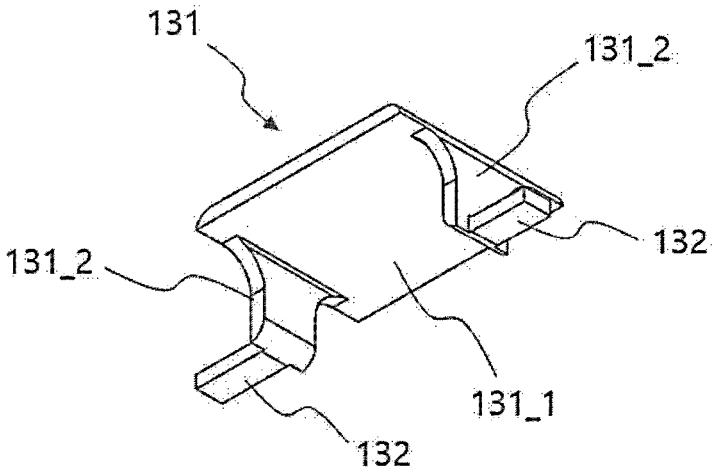
FIG. 9 is a perspective view of the main communication hole cover according to the embodiment of the present invention.
Figure 10:
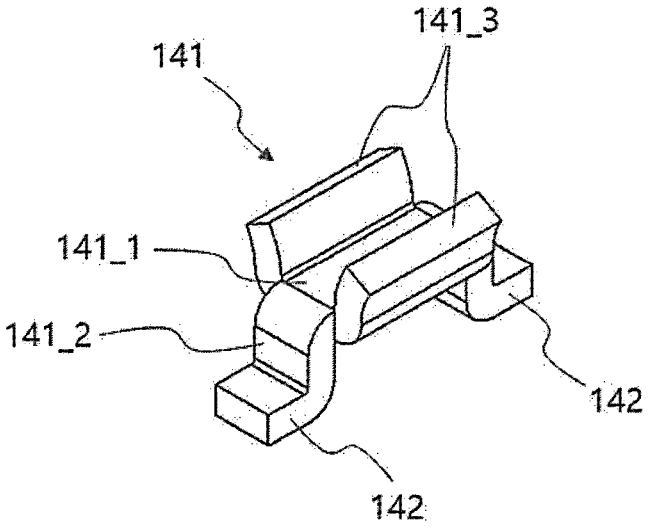
FIG. 10 is a perspective view of the auxiliary communication hole cover according to the embodiment of the present invention.

FIG. 6 is an exploded perspective view of the header tank according to the embodiment of the present invention. A structure of the first header tank 100 will be described with reference to FIG. 6. The first header tank 100 includes the outer header plate 110 configured to define the outer periphery of the header tank, and the inner header plate 120 coupled to the plurality of tubes 10 and the outer header plate 110 and configured to define the closed cross-section. The center of the inner header plate 120 and the center of the outer header plate 110 are bent inward and divide the flow path. Therefore, the flow path of the first header tank 100 is divided into the plurality of spaces in the width direction.

The main communication hole 130 and the auxiliary communication hole 140 are formed in the outer header plate 110, and the fluid moves from the fourth tank zone TZ_4 to the fifth tank zone TZ_5 through the main communication hole 130 and the auxiliary communication hole 140. In this case, a main communication hole cover 131 is inserted into the main communication hole 130, and an auxiliary communication hole cover 141 is inserted into a position of the auxiliary communication hole 140. As described above, in the present invention, in the structure in which the centers of the header tanks are spaced apart from each other to discharge condensate water, a refrigerant communication structure between first and second rows is implemented as a cover structure, such that the header tanks may be effectively assembled.

Meanwhile, a flow path baffle 310 having a fluid inlet hole is disposed at one end of the first header tank 100 based on the longitudinal direction, and the baffles, which block the flow path, are disposed at the other end and the center of the first header tank 100 based on the longitudinal direction.

Even though the structure of the second header tank 200 positioned opposite to the first header tank 100 is not illustrated in detail in the drawings, the second header tank 200 is identical in configuration to the first header tank 100, except for the components such as the center baffle and the communication hole.

FIG. 6 is a view for explaining the main communication hole 130 and the auxiliary communication hole 140 according to the embodiment of the present invention. With reference to FIG. 6, the auxiliary communication hole 140 may have a smaller area than the main communication hole 130.

Table 1 below shows a result of comparing and testing performance and a core part temperature difference while changing area ratios to the main communication hole 130 in a case (Base) in which the auxiliary communication hole 140 is not present and a case in which the auxiliary communication hole 140 is present. As shown in Table 1, it can be ascertained that in Case 4 in which the area ratio is 6.5%, the core part temperature difference is uniformized as 45% in comparison with Base, and the performance is also as high as 100.8% and higher than that in Base. It can be ascertained that in case that an area ratio of the auxiliary communication hole 140 is 10% or more in comparison with the main communication hole 130, the amount of refrigerant, which is larger than necessary, flows to the auxiliary communication hole 140, such that the refrigerant distribution is degraded, the performance deteriorates. Further, it can be ascertained that the refrigerant distribution is uniformized as the area ratio decreases, and the temperature distribution is improved.

TABLE 1

| | Base | Case 1 | Case 2 | Case 3 | Case 4 | Case 5 |
|---|---|---|---|---|---|---|
| Area ratio | No auxiliary communication hole | 20% | 14.7% | 10.2% | 6.5% | 3.7% |
| Performance ratio | 100% (Reference) | 97.9% | 98.8% | 98.7% | 100.8% | 101.7% |
| Core part temperature difference ratio | 100% (Reference) | 91% | 82% | 82% | 45% | 36% |

Therefore, it can be ascertained that the auxiliary communication hole 140 is formed to have a smaller area than the main communication hole 130, and a distribution of the refrigerant is uniformized as the area of the auxiliary communication hole 140 is smaller than the area of the main communication hole 130, such that the temperature distribution may be improved. Particularly, when the area of the auxiliary communication hole 140 is 6.5% or less of the area of the main communication hole 130, the uniform distribution of the refrigerant may be maintained, the drainage performance may be improved, and condensate water may be effectively discharged. In this case, the main communication hole 130 may be formed to be close to the baffle 300 at the center.

FIGS. 7 to 10 are views for explaining the structures of the main communication hole cover 131 and the auxiliary communication hole cover 141 and the structure for fastening the main communication hole cover 131 and the auxiliary communication hole cover 141 according to the embodiment of the present invention. With reference to FIGS. 7 to 10, the main communication hole cover 131 includes a main communication hole main shield part 131_1 configured to block an upper side, and main communication hole lateral shield parts 131_2 configured to block two opposite ends to prevent the fluid passing through the main communication hole 130 from leaking to the outside, and main communication fastening protruding portions 132 protrude from the two opposite ends to have a predetermined size. The auxiliary communication hole cover 141 also includes an auxiliary communication hole main shield part 141_1 configured to block an upper side, and auxiliary communication hole lateral shield parts 141_2 configured to block two opposite ends to prevent the fluid passing through the auxiliary communication hole 140 from leaking to the outside, and auxiliary communication fastening protruding portions 142 protrude from the two opposite ends to have a predetermined size. The auxiliary communication hole cover 141 additionally has auxiliary communication header plate insertion portions 141_3 inserted into and coupled to the header plate and protruding upward to the two opposite sides.

Figure 11:
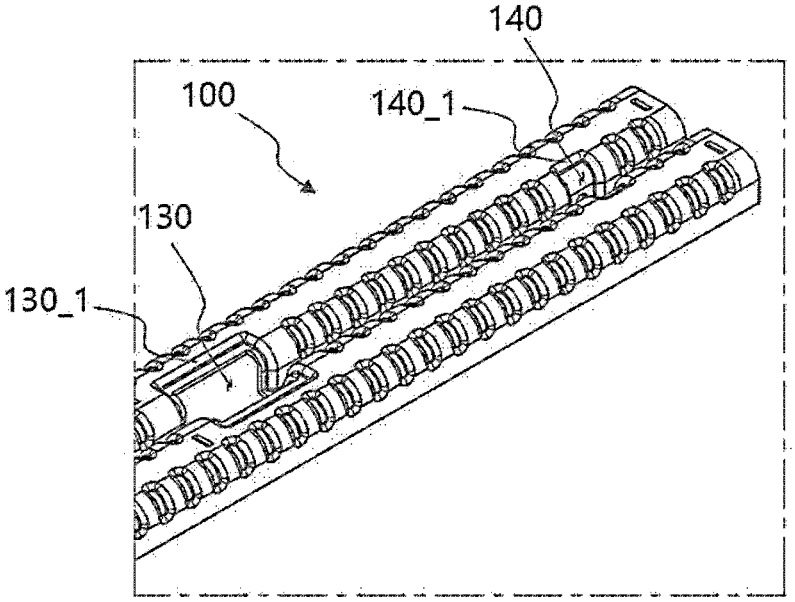
FIG. 11 is a view for explaining a main communication hole seating portion and an auxiliary communication hole seating portion according to the embodiment of the present invention.

FIG. 11 is a view for explaining a main communication hole seating portion and an auxiliary communication hole seating portion according to the embodiment of the present invention. With reference to FIG. 11, seating portions may be formed at the periphery of the main communication hole 130 and the auxiliary communication hole 140 and partially recessed so that the main communication hole cover 131 and the auxiliary communication hole cover 141 may be inserted and seated.

Figure 12:
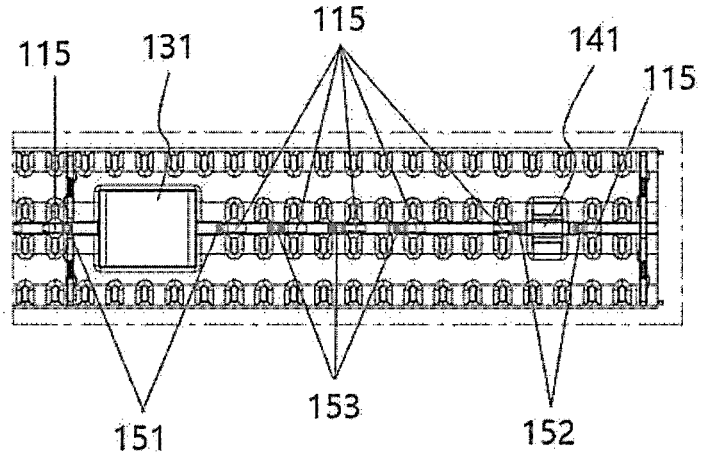
FIG. 12 is a view for explaining a structure for coupling the main communication hole cover, the auxiliary communication hole cover, and a header plate according to the embodiment of the present invention when viewed from above.

FIG. 12 is a view for explaining a structure for coupling the main communication hole cover, the auxiliary communication hole cover, and the header plate according to the embodiment of the present invention. With reference to FIG. 12, a main communication fastening tab 151 protrudes from the recessed portion of the inner header plate 120 to couple the main communication hole cover 131, and an auxiliary communication fastening tab 152 protrudes to couple the auxiliary communication hole cover 141, such that the main communication fastening protruding portion 132 of the main communication hole cover 131 is coupled to the main communication fastening tab 151, and the auxiliary communication fastening protruding portion 142 of the auxiliary communication hole cover 141 is coupled to the auxiliary communication fastening tab 152.

In addition, a header plate fastening tab 153 protrudes from the recessed portion of the inner header plate 120 to couple the outer header plate 110, and a header plate fixing groove 115, into which the header plate fastening tab 153 is inserted, is formed in the recessed portion of the outer header plate 110, such that the inner header plate 120 and the outer header plate 110 are coupled. In this case, a height of the main communication fastening tab 151 and the auxiliary communication fastening tab 152 is higher than a height of the header plate fastening tab 153, such that the main communication fastening tab 151 and the auxiliary communication fastening tab 152 may be more stably coupled. According to the embodiment of the present invention, the main communication hole 130 and the auxiliary communication hole 140 is applied as the same basic structure, which may improve assemblability. The auxiliary communication hole cover 141 may be formed to be larger in size than the auxiliary communication hole 140 and lower in height than the main communication hole cover 131, such that the auxiliary communication hole 140 having a small communication area is stably joined to the header tank.

Figure 13:
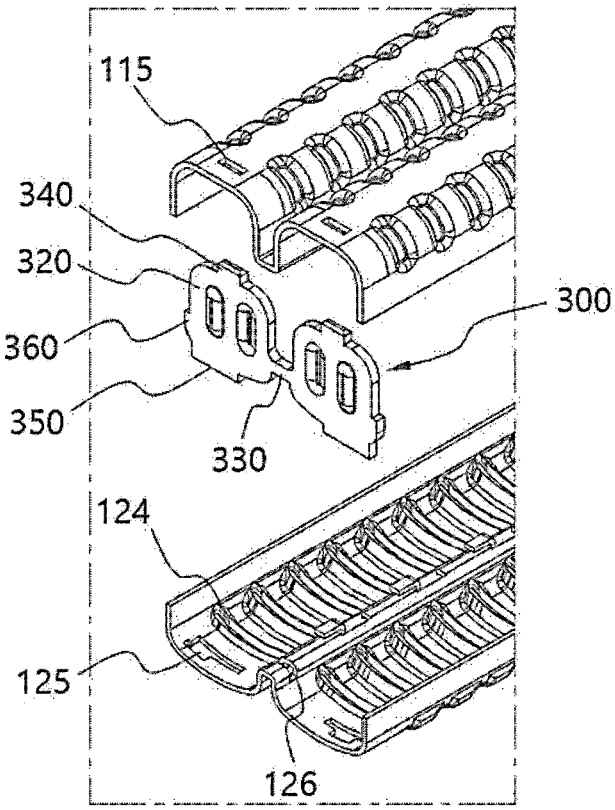
FIG. 13 is a view for explaining a structure for coupling a baffle according to the embodiment of the present invention.

FIG. 13 is a view for explaining a structure for coupling the baffle 300 according to the embodiment of the present invention. With reference to FIG. 13, the first header tank 100 further includes the baffle 300 configured to divide the flow path in the longitudinal direction or close one end in the longitudinal direction. The baffle 300 includes baffle plates 320 configured to block the flow path and formed at two opposite sides of the separation wall, a baffle connection portion 330 configured to connect the baffle plates 320, baffle outer coupling portions 340 formed at upper sides of the baffle plates 320 and inserted into outer coupling grooves 114 formed in the outer header plate 110, and baffle inner coupling portions 350 formed at lower sides of the baffle plates 320 and inserted into inner coupling grooves 125 formed in the inner header plate 120. In this case, a baffle coupling groove 126 is formed in the recessed portion of the inner header plate 120, and the baffle connection portion 330 is inserted into the baffle coupling groove 126, such that the baffle may be more stably assembled by using the structure in which the separation walls of the header tanks are spaced apart from each other, which may improve assemblability. That is, the baffle connection portion 330 at the center of the baffle is inserted and seated into the baffle coupling groove 126 formed through the header tank, and then the header tank is assembled, which improves assemblability.

In addition, the coupling position between the outer header plate 110 and the inner header plate 120 is guided by using a stepped portion of a baffle lateral coupling portion 360 protruding from a lateral surface of the baffle, which may improve fastening strength.

Figure 14:
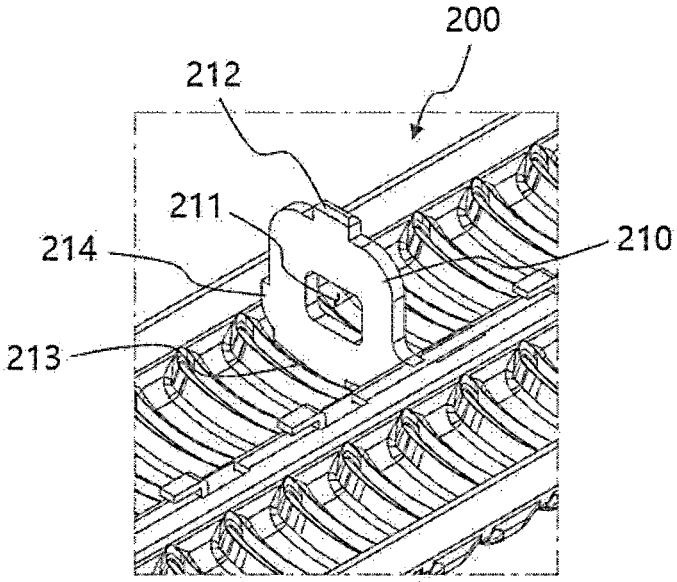
FIG. 14 is a view for explaining a structure for coupling a throttle plate according to the embodiment of the present invention.

FIG. 14 is a view for explaining a structure for coupling the throttle plate according to the embodiment of the present invention. With reference to FIG. 14, the first throttle plate 210 includes a throttle opening 211 through which the fluid passes, a throttle inner coupling portion 212 coupled to the inner header plate 120, and a throttle outer coupling portion 213 coupled to the outer header plate 110. Like the above-mentioned structure for assembling the baffle 300, the coupling position is guided by using the recessed separation wall at the center, which may improve assemblability. The second throttle plate 220 may also be formed to have the same structure as the first throttle plate 210 and be assembled.

Figure 15:
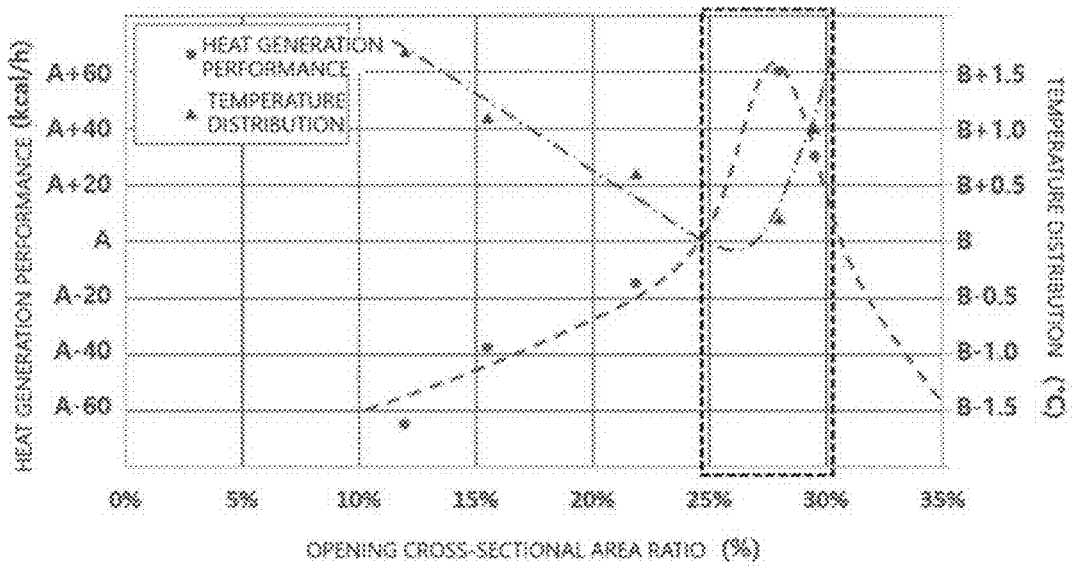
FIG. 15 is a test result graph showing heat generation performance and a temperature distribution effect in accordance with an opening cross-sectional area ratio between a throttle plate and a tank cross-section.

Meanwhile, an area of the throttle plate affects heat generation performance and a temperature distribution of the heat exchanger. FIG. 15 is a test result graph showing heat generation performance and a temperature distribution effect in accordance with an opening cross-sectional area ratio between the throttle plate and a tank cross-section. An effect of the opening cross-sectional area ratio of the throttle plate on the heat generation performance and the temperature distribution of the heat exchanger will be described with reference to FIG. 15.

The test result in FIG. 15 will be described in detail. The heat generation performance and the temperature distributions were compared and tested by changing the opening cross-sectional area of the first throttle plate 210 or the second throttle plate 220 to 10 to 30% of the tank cross-sectional area. The left side of the graph indicates a relative heat generation performance test value when a reference heat generation performance is A, and the right side of the graph indicates a relative temperature distribution test value when a reference temperature distribution is B. It is interpreted that the better result is achieved as the heat generation performance becomes higher and the temperature distribution becomes smaller.

According to the test result, it can be ascertained that when the opening cross-sectional area of the first throttle plate 210 or the second throttle plate 220 has a range of 25 to 30% of the tank cross-sectional area, the heat generation performance, which is higher than a criterion, and the temperature distribution does not significantly deviate from the criterion. That is, when the first throttle plate 210 or the second throttle plate 220 is within the 25 to 30% of the tank cross-sectional area, the temperature distribution is not significantly degraded, and the high heat generation performance is exhibited.

Figure 16:
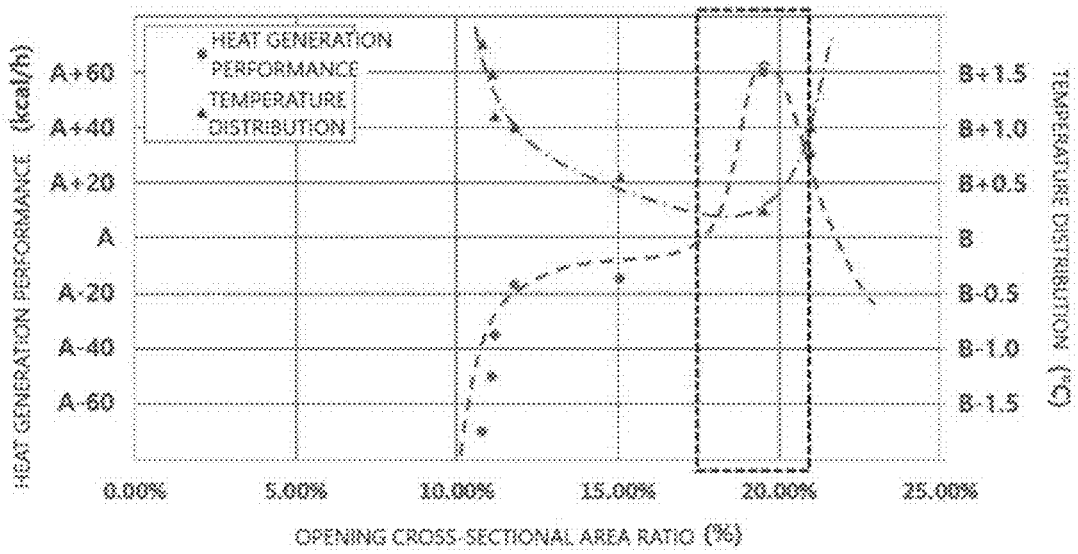
FIG. 16 is a test result graph showing heat generation performance and a temperature distribution effect in accordance with an opening cross-sectional area ratio between the throttle plate and a tube flow path cross-section.

In addition, the opening cross-sectional area ratio between the throttle plate and the tube flow path cross-section also affects the heat generation performance and the temperature distribution of the heat exchanger. FIG. 16 is a test result graph showing heat generation performance and a temperature distribution effect in accordance with an opening cross-sectional area ratio between the throttle plate and a tube flow path cross-section. An effect of the opening cross-sectional area ratio between the throttle plate and the tube flow path cross-section on the heat generation performance and the temperature distribution of the heat exchanger will be described with reference to FIG. 16.

The horizontal axis in FIG. 16 indicates the ratio of the opening cross-sectional area of the first or second throttle plate to the cross-sectional area of the tube flow path, the left side of the graph indicates a relative heat generation performance test value when a reference heat generation performance is A, and the right side of the graph indicates a relative temperature distribution test value when a reference temperature distribution is B. It is interpreted that the better result is achieved as the heat generation performance becomes higher and the temperature distribution becomes smaller.

According to the test result, it can be ascertained that when the opening cross-sectional area of the first throttle plate 210 or the second throttle plate 220 has a range of 18 to 21% of the tube flow path cross-sectional area, the heat generation performance, which is higher than a criterion, and the temperature distribution does not significantly deviate from the criterion. That is, when the first throttle plate 210 or the second throttle plate 220 is within the 18 to 21% of the tank cross-sectional area, the temperature distribution is not significantly degraded, and the high heat generation performance is exhibited.

Figure 17:
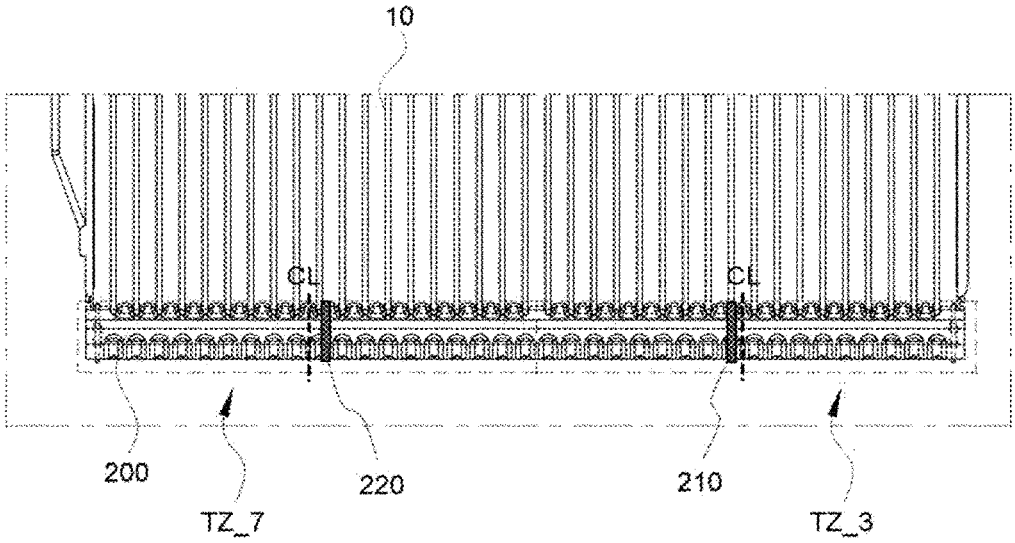
FIG. 17 is a view for explaining a position of the throttle plate.
Figure 18:
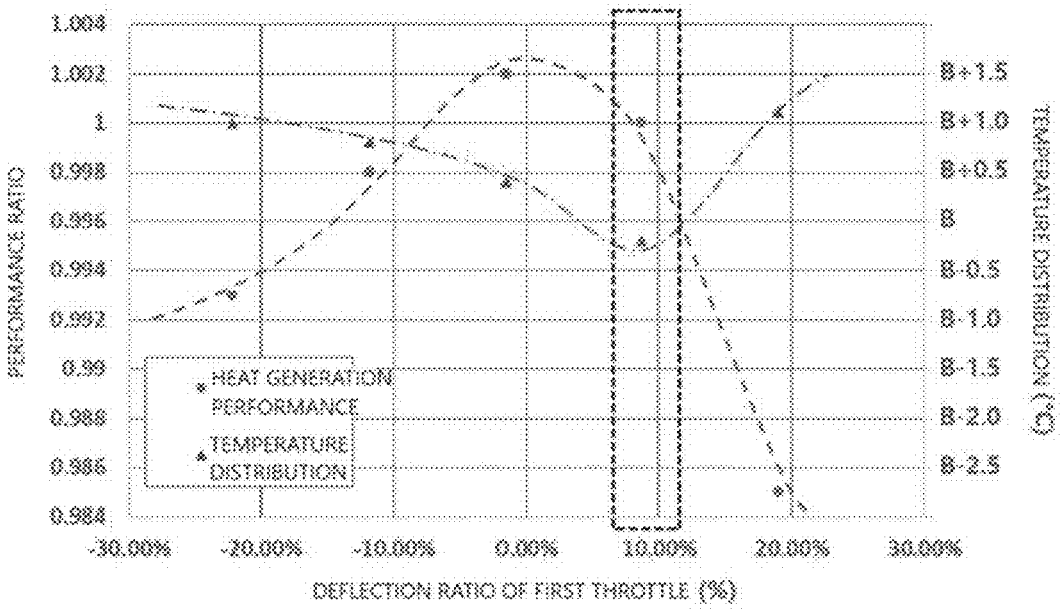
FIG. 18 is a test result graph showing heat generation performance and a temperature distribution effect in accordance with a deflection ratio of a first throttle plate.

Meanwhile, the position of the throttle plate is appropriately disposed to be slightly deflected from the center of each of the tank zones. FIG. 17 is a view for explaining a deflection position of the throttle plate. With reference to FIG. 18, the first throttle plate 210 is appropriately disposed to be deflected from the center of the third tank zone TZ_3 toward the center of the second header tank 200, and the second throttle plate 220 is appropriately disposed to be deflected from the center of the seventh tank zone TZ_7 toward the center of the second header tank 200.

An effect of the deflection of the throttle plate on the heat generation performance and the temperature distribution of the heat exchanger will be described with reference to Table 2 below and FIGS. 18 and 19.

TABLE 2

| | Case 1 | Case 2 | Case 3 | Case 4 | Case 5 |
|---|---|---|---|---|---|
| First throttle plate deflection ratio (%) | −22.2% | −11.9% | −1.6% | +8.7% | +19.0% |
| Second throttle plate deflection ratio (%) | −20.7% | −9.9% | −1.0% | +11.9% | +22.8% |

Table 2 shows deflection ratios of the first throttle plate and the second throttle plate for respective test cases. In this case, '+' and '−' indicate deflection positions, '+' means the deflection toward the center of the entire heat exchanger, and '−' means the deflection toward the side opposite to the center. For example, '+' means a case in which the first throttle plate 210 moves from the center of the third tank zone TZ_3 toward the second tank zone TZ_2, and '+' means a case in which the second throttle plate 220 moves from the center of the seventh tank zone TZ_7 to the sixth tank zone TZ_6. Meanwhile, the amount of deflection is represented by percentage of a deflection length to a length of each of the tank zones.

Figure 19:
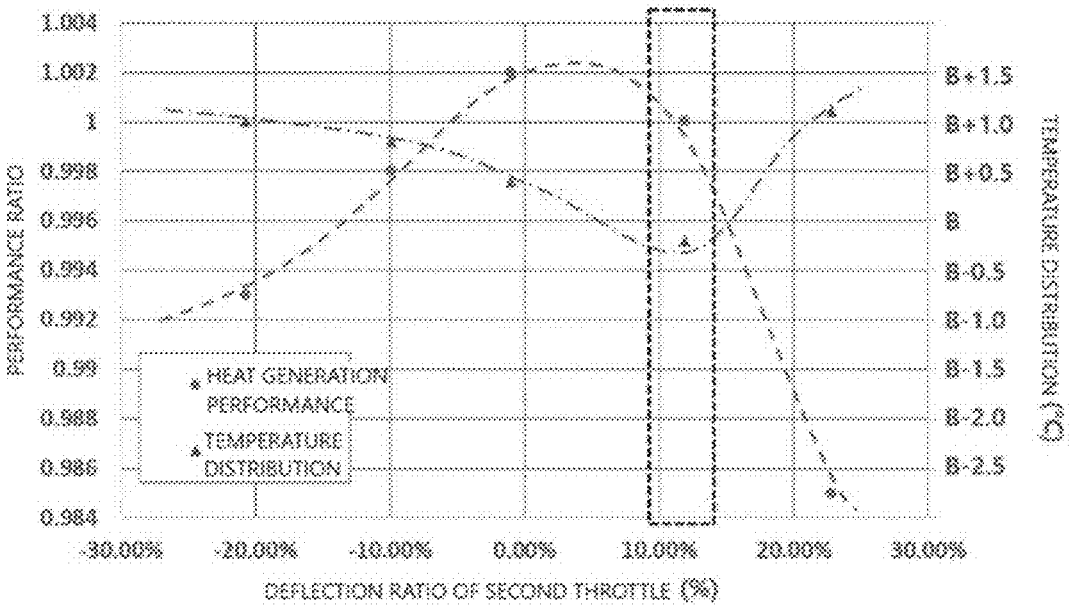
FIG. 19 is a test result graph showing heat generation performance and a temperature distribution effect in accordance with a deflection ratio of a second throttle plate.

FIG. 18 is a test result graph showing heat generation performance and a temperature distribution effect in accordance with a deflection ratio of the first throttle plate, and FIG. 19 is a test result graph showing heat generation performance and a temperature distribution effect in accordance with a deflection ratio of the second throttle plate. The left sides of the graphs indicate performance ratios configured to predict the criteria, and the right sides of the graphs indicate temperature distributions.

With reference to FIG. 18, it is shown that when the deflection ratio of the first throttle plate is 8 to 9%, the heat generation performance is maintained, and the effect of reducing the temperature distribution is excellent. With reference to FIG. 19, it is shown that when the deflection ratio of the second throttle plate is 11 to 12%, the heat generation performance is maintained, and the effect of reducing the temperature distribution is excellent.

That is, the first throttle plate 210 is appropriately disposed to be deflected from the center of the third tank zone TZ_3 to the second tank zone TZ_2 by 8 to 9% of the length of the third tank zone TZ_3, and the second throttle plate 220 is appropriately disposed to be deflected from the center of the seventh tank zone TZ_7 to the sixth tank zone TZ_6 by 11 to 12% of the length of the seventh tank zone TZ_7.

DESCRIPTION OF REFERENCE NUMERALS

1: Heat exchange system
2: Compressor
3: Condenser
4: Expansion valve
5: Evaporator
10: Tube
1000: Heat exchanger
100: First header tank
110: Outer header plate
110_1: First bent portion
110_2: First through-hole
111: First outer partition wall
112: Second outer partition wall
113: Outer coupling portion
114: Outer coupling groove
115: Header plate fixing groove
120: Inner header plate
120_1: Second bent portion
120_2: Second through-hole
121: First inner partition wall
122: Second inner partition wall
123: Inner coupling portion
124: Tube coupling groove
125: Inner coupling groove
126: Baffle coupling groove
130: Main communication hole
130_1: Main communication hole seating portion
131: Main communication hole cover
131_1: Main communication hole main shield part
131_2: Main communication hole lateral shield part
132: Main communication fastening protruding portion
140: Auxiliary communication hole
140_1: Auxiliary communication hole seating portion
141: Auxiliary communication hole cover
141_1: Auxiliary communication hole main shield part
141_2: Auxiliary communication hole lateral shield part
141_3: Auxiliary communication header plate insertion portion
142: Auxiliary communication fastening protruding portion
151: Main communication fastening tab
152: Auxiliary communication fastening tab
153: Header plate fastening tab
200: Second header tank
210: First throttle plate
220: Second throttle plate
211: Throttle opening
212: Throttle inner coupling portion
213: Throttle outer coupling portion
214: Throttle lateral coupling portion
300: Baffle
310: Flow path baffle
320: Baffle plate
330: Baffle connection portion
340: Baffle outer coupling portion
350: Baffle inner coupling portion
360: Baffle lateral coupling portion
TZ_1: First tank zone
TZ_2: Second tank zone
TZ_3: Third tank zone
TZ_4: Fourth tank zone
TZ_5: Fifth tank zone
TZ_6: Sixth tank zone
TZ_7: Seventh tank zone
TZ_8: Eighth tank zone The embodiment of the present invention has been specifically described above with reference to the accompanying drawings.

The above description is simply given for illustratively describing the technical spirit of the present invention, and those skilled in the art to which the present invention pertains will appreciate that various modifications, changes, and substitutions are possible without departing from the essential characteristic of the present invention.

Accordingly, the embodiments disclosed in the present invention and the accompanying drawings are intended not to limit but to describe the technical spirit of the present invention, and the scope of the technical spirit of the present invention is not limited by the embodiments and the accompanying drawings. The protective scope of the present invention should be construed based on the following claims, and all the technical spirit in the equivalent scope thereto should be construed as falling within the scope of the present invention.

INDUSTRIAL APPLICABILITY

The present invention relates to the heat exchanger and is industrially available.

The invention claimed is:

1. A heat exchanger comprising:

first and second header tanks into and from which a cooling fluid is introduced and discharged, the first and second header tanks being spaced apart from each other at a predetermined distance; and a core part disposed between the first and second header tanks, having a plurality of tubes and fins, and configured to perform a movement of the cooling fluid and heat exchange of the cooling fluid, wherein the first or second header tank comprises:

an outer header plate configured to define an outer periphery of the tank; and an inner header plate coupled to the plurality of tubes and the outer header plate and configured to define a closed cross-section, wherein a center of the outer header plate includes a first bent portion recessed toward the core part, wherein a drain hole is formed in the first bent portion, and wherein a predetermined region of the outer header plate is penetrated, and a main communication hole and an auxiliary communication hole are formed to allow flow paths, which are divided into a plurality of tank zones, to communicate with one another.

2. The heat exchanger of claim 1, wherein a main communication hole plate is coupled to a penetration region of the outer header plate having the main communication hole, and an auxiliary communication hole cover is coupled to a penetration region of the outer header plate having the auxiliary communication hole.

3. The heat exchanger of claim 2, wherein the main communication hole is formed to have a larger area than the auxiliary communication hole, and a height of a main communication cover plate is higher than a height of an auxiliary communication cover plate.

4. The heat exchanger of claim 3, wherein an area of the auxiliary communication hole is 6.5% or less of an area of the main communication hole.

5. A heat exchanger comprising:

first and second header tanks into and from which a cooling fluid is introduced and discharged, the first and second header tanks being spaced apart from each other at a predetermined distance; and a core part disposed between the first and second header tanks, having a plurality of tubes and fins, and configured to perform a movement of the cooling fluid and heat exchange of the cooling fluid, wherein the first or second header tank comprises:

an outer header plate configured to define an outer periphery of the tank; and an inner header plate coupled to the plurality of tubes and the outer header plate and configured to define a closed cross-section, wherein a center of the outer header plate includes a first bent portion recessed toward the core part, wherein a drain hole is formed in the first bent portion, and wherein a header plate fastening tab protrudes from a recessed portion of the inner header plate and is coupled to the outer header plate, a header plate fixing groove, into which the header plate fastening tab is inserted, is formed in a recessed portion of the outer header plate, and condensate water is discharged through the header plate fixing groove.

6. The heat exchanger of claim 5, wherein a main through-hole and an auxiliary through-hole, through which the cooling fluid flows, are formed as a predetermined region of the outer header plate is penetrated, a main communication hole cover is coupled to a penetration region of the outer header plate having the main communication hole, an auxiliary communication hole plate is coupled to a penetration region of the outer header plate having the auxiliary communication hole, a main communication fastening tab protrudes from the recessed portion of the inner header plate to couple the main communication hole cover, and an auxiliary communication fastening tab protrudes from the recessed portion of the inner header plate to couple the auxiliary communication hole cover.

7. The heat exchanger of claim 6, wherein main communication fastening protruding portions protrude from two opposite sides of the main communication hole cover and are coupled to the main communication fastening tab, or auxiliary communication fastening protruding portions protrude from two opposite sides of the auxiliary communication hole cover and are coupled to the auxiliary communication fastening tab.

8. The heat exchanger of claim 1, wherein the outer header plate comprises:

a first outer partition wall recessed and bent toward the inside of the header tank;

an outer coupling portion bent and extending from the first outer partition wall; and a second outer partition wall bent and extending from the outer coupling portion to the outside of the header tank, wherein the inner header plate comprises:

a first inner partition wall recessed and bent toward the inside of the header tank;

an inner coupling portion bent and extending from the first inner partition wall; and a second inner partition wall bent and extending from the inner coupling portion to the outside of the header tank, and wherein the outer coupling portion of the outer header plate and the inner coupling portion of the inner header plate are in contact with each other to define a closed cross-section.

9. The heat exchanger of claim 8, wherein a height of the first outer partition wall and the second outer partition wall of the outer header plate is 60% or more of a height of the header tank.

10. The heat exchanger of claim 9, wherein the first header tank further comprises a baffle configured to divide the flow path in the longitudinal direction or block one end in the longitudinal direction, and wherein the baffle comprises:

baffle plates configured to block the flow path and formed at two opposite sides of a separation wall;

a baffle connection portion configured to connect the baffle plates;

baffle outer coupling portions formed at upper sides of the baffle plates and inserted into outer coupling grooves formed in the outer header plate; and baffle inner coupling portions formed at lower sides of the baffle plates and inserted into inner coupling grooves formed in the inner header plate.

11. The heat exchanger of claim 10, wherein a baffle coupling groove is formed in the recessed portion of the inner header plate, and the baffle connection portion is inserted into the baffle coupling groove.

12. A heat exchanger comprising:

first and second header tanks into and from which a cooling fluid is introduced and discharged, the first and second header tanks being spaced apart from each other at a predetermined distance; and a core part disposed between the first and second header tanks, having a plurality of tubes and fins, and configured to perform a movement of the cooling fluid and heat exchange of the cooling fluid, wherein the first or second header tank comprises:

an outer header plate configured to define an outer periphery of the tank; and an inner header plate coupled to the plurality of tubes and the outer header plate and configured to define a closed cross-section, wherein a center of the outer header plate includes a first bent portion recessed toward the core part, wherein a drain hole is formed in the first bent portion, and wherein the first header tank and the second header tank are divided in accordance with a flow of the fluid, a region in which the fluid is introduced into the first header tank is a first tank zone, an end region of a first pass through which the fluid descends from the first tank zone to the second header tank is a second tank zone, one end region of a second pass connected to the second tank zone in the longitudinal direction and configured to allow the fluid to ascend to the first header tank is a third tank zone, the other end region of the second pass is a fourth tank zone, a region connected to the fourth tank zone through the main communication hole and the auxiliary communication hole is a fifth tank zone, an end region of a third pass through which the fluid descends from the fifth tank zone to the second header tank is a sixth tank zone, one end region of a fourth pass connected to the sixth tank zone in the longitudinal direction and configured to allow the fluid to ascend to the first header tank is a seventh tank zone, a region, which is the other end region of the fourth pass through which the fluid is discharged to the outside of the heat exchanger, is an eighth tank zone, a first throttle plate is disposed in the third tank zone, and a second throttle plate is disposed in the seventh tank zone.

13. The heat exchanger of claim 12, wherein the first or second throttle plate comprises:

a throttle opening through which the fluid passes;

a throttle inner coupling portion coupled to the inner header plate; and a throttle outer coupling portion coupled to the outer header plate.

14. The heat exchanger of claim 13, wherein a cross-sectional area of the throttle opening is 25 to 30% of a cross-sectional area of the header tank.

15. The heat exchanger of claim 13, wherein a cross-sectional area of the throttle opening is 18 to 21% of a tube flow path cross-sectional area.

16. The heat exchanger of claim 12, wherein the first throttle plate is disposed to be deflected from a center of the third tank zone to the second tank zone, or the second throttle plate is disposed to be deflected from a center of the seventh tank zone to the sixth tank zone.

17. The heat exchanger of claim 16, wherein the first throttle plate is disposed to be deflected from the center of the third tank zone to the second tank zone by 8 to 9% of a length of the third tank zone, or the second throttle plate is disposed to be deflected from the center of the seventh tank zone to the sixth tank zone by 11 to 12% of a length of the seventh tank zone.

* * * * *